US008081086B2

(12) United States Patent
Keidar et al.

(10) Patent No.: US 8,081,086 B2
(45) Date of Patent: Dec. 20, 2011

(54) AVI TRANSPONDER WITH AUDIO ANNOUNCEMENTS MEANS

(76) Inventors: Gyora Keidar, Ra'anana (IL); Eddy Kafry, Hod Hasharon (IL)

( * ) Notice: Subject to any disclaimer, the term of this patent is extended or adjusted under 35 U.S.C. 154(b) by 330 days.

(21) Appl. No.: 12/419,329

(22) Filed: Apr. 7, 2009

(65) Prior Publication Data

US 2010/0007526 A1 Jan. 14, 2010

Related U.S. Application Data

(60) Provisional application No. 61/079,491, filed on Jul. 10, 2008.

(51) Int. Cl.
*G08G 1/09* (2006.01)

(52) U.S. Cl. ..... 340/905

(58) Field of Classification Search ..... 340/905, 340/928, 572.1–572.9, 10.1
See application file for complete search history.

(56) References Cited

U.S. PATENT DOCUMENTS

| | | | | |
|---|---|---|---|---|
| 6,958,707 | B1 | 10/2005 | Siegel | |
| 2004/0233045 | A1* | 11/2004 | Mays | 340/425.5 |
| 2005/0237154 | A1* | 10/2005 | Kafry et al. | 340/10.1 |
| 2005/0237223 | A1* | 10/2005 | Nishiwaki | 340/928 |
| 2006/0047415 | A1 | 3/2006 | Groskreutz et al. | |

* cited by examiner

*Primary Examiner* — Phung Nguyen
(74) *Attorney, Agent, or Firm* — AlphaPatent Associates Ltd.; Daniel J. Swirsky

(57) ABSTRACT

An automatic vehicle identification (AVI) unit includes a transponder to communicate with an interrogator regarding at least an identification of a vehicle in which the AVI unit is located, and an audio speaker to broadcast verbal announcements based on information received from the interrogator. A highway monitoring and broadcast system includes means to collect and analyze activity on the highway and to determine when such activity requires sending information to vehicles on the highway, and an interrogator to communicate with AVI transponders installed in the vehicles.

16 Claims, 3 Drawing Sheets

AVI TRANSPONDER WITH AUDIO ANNOUNCEMENTS MEANS

CROSS-REFERENCE TO RELATED APPLICATIONS

This application claims benefit from U.S. Provisional Patent Application No. 61/079,491, filed Jul. 10, 2008, which is hereby incorporated in its entirety by reference.

FIELD OF THE INVENTION

The present invention relates in general to automatic vehicle identification (AVI) transponders and to equipping them with audio messages in particular.

BACKGROUND OF THE INVENTION

Automatic vehicle identification (AVI) is known in the art.

A common use for AVI is to electronically monitor and charge vehicles entering or moving on toll highways by means of an interrogator and transponder. The interrogator is a transmitter/receiver device owned by the highway operator that communicates with transponders that are installed within the vehicles. One or more of such interrogators are installed at the entrance or at specific locations along sections of the highway. Upon receipt of a valid interrogation signal, the vehicle transponder responds by transmitting the identity of the car (or any other unique signal enabling the identification of the car) to the interrogator. Upon receipt and processing of the transponder signal, the highway operator can charge the car owner for using the highway.

The interrogators and transponders usually operate by means of electromagnetic signals, but other types of communication means, for example, optical, ultrasonic, etc may also be used. Most commonly, the interrogators and transponders operate by means of RF signals, and therefore the transponder is sometimes referred to as "RF ID". Furthermore, specific protocol standards, as well as proprietary protocols, have been developed for such interrogator-transponders communication, for example ASTM V6 and CALTRANS Title 21.

FIG. 1, to which reference is now made, shows a typical AVI transponder 1 together with an optional hanging device 2. Transponder 1 is generally attached to the internal surface of the front vehicle window (windshield), or to a location close to the window by means of some attachment device. For example, the device may be attached to the window by means of hanging device 2. Hanging device 2 typically has a double sided adhesive (not shown) at its rear surface, and hangers 3*a* and 3*b* at the front. Hanging device 2 is generally attached to the windshield at a location which at most minimally obstructs a driver's view; for example, behind the front mirror.

Typically, transponder 1 is an electronic card or a small circuit which is mounted within a closed, sometimes molded casing. Transponder 1 typically comprises means to provide an electronic beep which may be used to occasionally alert the driver as the car passes an interrogator at the beginning/end of a section of the highway.

Such transponders and interrogators are also commonly used in other applications. For example, transponders 1 can also be used as is, or with minimal modification, to facilitate weigh in motion (WIM) applications, access control and management, traffic management probes and other location based services.

SUMMARY OF THE INVENTION

An object of the present invention is to improve upon the prior art.

There is therefore provided in accordance with a preferred embodiment of the present invention, an automatic vehicle identification (AVI) unit including a transponder to communicate with an interrogator regarding at least an identification of a vehicle in which the AVI unit is located, and an audio speaker to broadcast verbal announcements based on information received from the interrogator.

Further, in accordance with a preferred embodiment of the present invention, the AVI unit also includes a translator module to translate the information to the announcements as per a list of commands and associated the verbal announcements.

Still further, in accordance with a preferred embodiment of the present invention, the translator module includes at least one of a command translator to translate system commands to pre-recorded audio announcements, and a text to speech translator to generate new audio announcements.

Additionally, in accordance with a preferred embodiment of the present invention, the verbal announcements relay information regarding at least one of road status, speed limitations, weather conditions and reminders.

Moreover, in accordance with a preferred embodiment of the present invention, the verbal announcements are relevant to a current location of the vehicle.

Further, in accordance with a preferred embodiment of the present invention, the interrogator is part of a highway monitoring system.

Still further, in accordance with a preferred embodiment of the present invention, the highway is a toll highway. 1

Additionally, in accordance with a preferred embodiment of the present invention, the interrogator is part of at least one of a weigh in motion (WIM) application, access control and management system, traffic management probe, and a location based service.

Moreover, in accordance with a preferred embodiment of the present invention, the transponder has standby and active modes, where when in the standby mode the transponder sends an identification signal upon receipt of an identification request from the interrogator, and when in the active mode the transponder receives commands from the interrogator.

Further, in accordance with a preferred embodiment of the present invention, the transponder is an electronic card located within a closed casing.

Still further, in accordance with a preferred embodiment of the present invention, the verbal announcements pertain to a current location of the vehicle.

There is also provided in accordance with a preferred embodiment of the present invention a highway monitoring and broadcast system including means to collect and analyze activity on the highway and to determine when such activity requires sending information to vehicles on the highway, and an interrogator to communicate with AVI transponders installed in the vehicles.

Further, in accordance with a preferred embodiment of the present invention, the means comprise an interface with at least one of a real-time traffic information system and a weather reporting system.

Still further, in accordance with a preferred embodiment of the present invention, the highway is a toll highway and the interrogators comprise means to receive identifying information from the AVI transponders, the identifying information being suitable for billing purposes.

Additionally, in accordance with a preferred embodiment of the present invention, the interrogator includes means to at least forward information to the vehicles, the information regarding at least one of road status, speed limitations, weather conditions and reminders.

Moreover, in accordance with a preferred embodiment of the present invention, the information is relevant to a current location of the vehicles.

Further, in accordance with a preferred embodiment of the present invention, the interrogator is part of at least one of a weigh in motion (WIM) application, access control and management system, traffic management probe, and a location based service.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
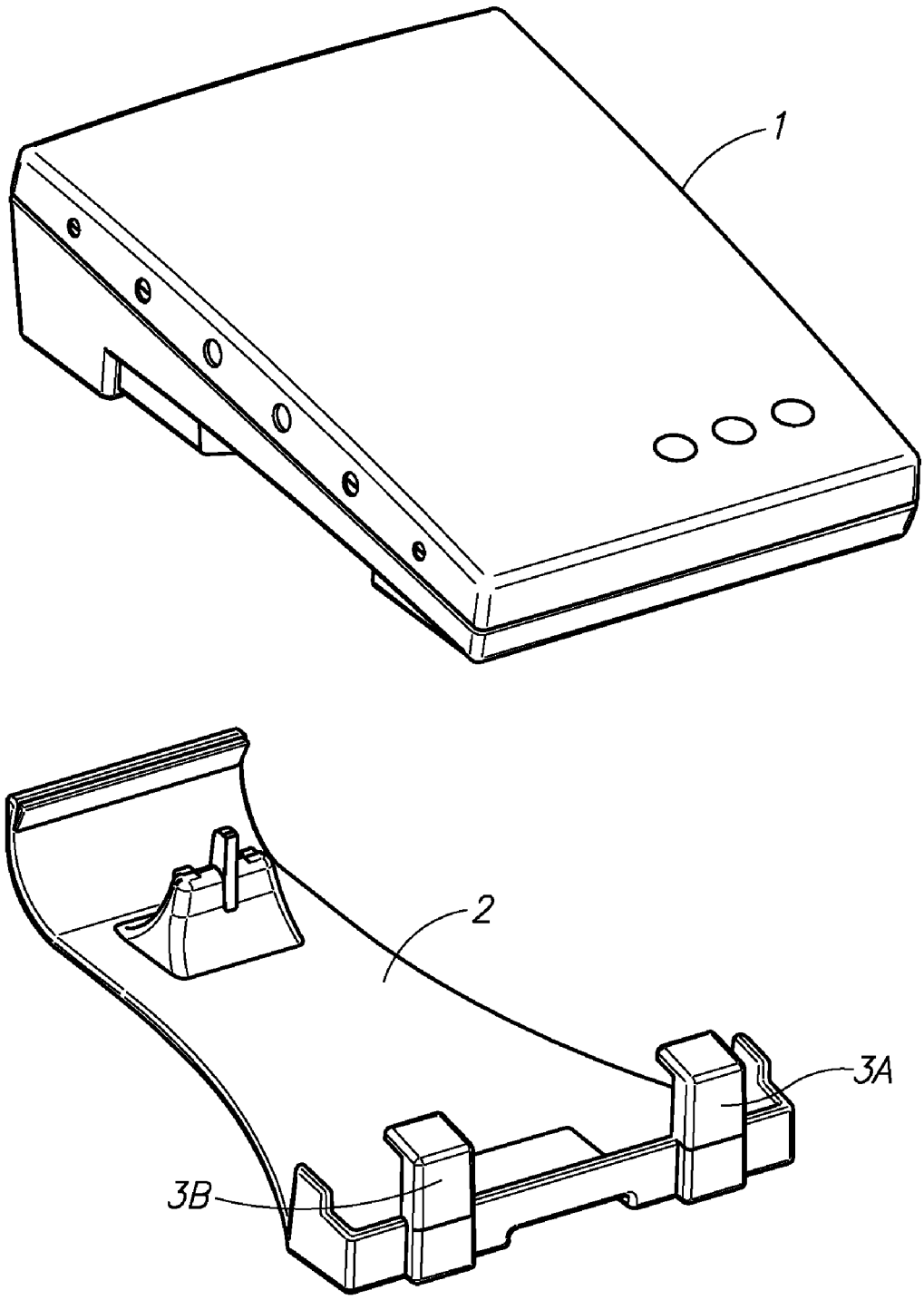
FIG. 1 is a schematic illustration of a prior art transponder.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

Applicants have realized that a transponder may be configured with a speaker system of to alert a driver with meaningful announcements. It is therefore an object of the present invention to provide an arrangement that will enable the highway operator to alert the driver using meaningful traffic and safety related announcements, such as "Slow down, heavy traffic ahead".

Therefore the present invention may relate, for example, to a transponder system for use in conjunction with an interrogator of a toll highway, which may comprise: (a) a transponder that sends an identification signal upon receipt of an interrogator signal; (b) an audio announcement circuit within the transponder; (c) a protocol that enables the toll highway operator to send audio announcements to the driver using the transponder.

Figure 2:
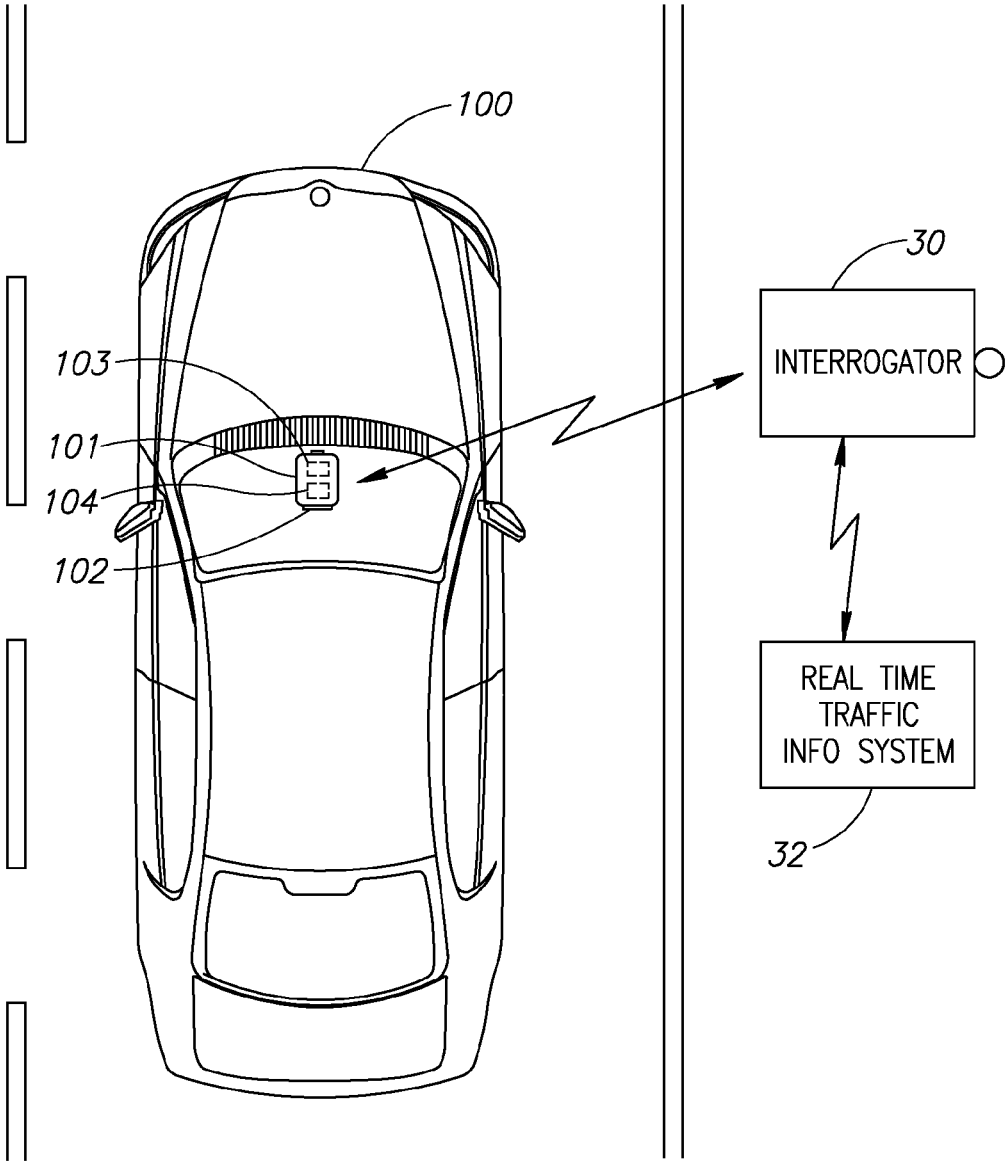
FIG. 2 is a schematic illustration of a novel toll highway monitoring and broadcast system, constructed and operative in accordance with a preferred embodiment of the present invention.

FIG. 2, to which reference is now made, is a schematic illustration of a novel toll highway monitoring and broadcast system 10, constructed and operative in accordance with a preferred embodiment of the present invention. Interrogator 30 may communicate with transponder 101 located within the vehicle 100. Transponder 101 may be attached to a portion of the vehicle, for example to its front window, by means of hanging device 102. Transponder 101 may comprise an audio announcement circuit 103 and a text to speech translator 104.

Circuit 103 may include a storage unit storing a pre-defined set of numbered announcements. These announcements may include road status information, speed limitations and/or reminders. Audio announcement circuit 103 may use this pre-defined set of numbered announcements to translate system commands from the interrogator into audio announcements. For example, the system command might be "announcement 3" which circuit 103 may translate into "accident ahead". It will be appreciated that the announcements may be pre-recorded in multiple languages and that the present invention is not language dependent. Furthermore, in accordance with a preferred embodiment of the present invention, circuit 103 may include an upgraded speaker circuit (relative to prior art transponders), in order to provide clear verbal announcements.

It will be appreciated that circuit 103 may not be limited to prerecorded messages. In accordance with a preferred embodiment of the present invention, text to speech translator 104 may translate text messages to audio announcements without prerecording. For example, instead of receiving system command "announcement 3" as in the previous embodiment, circuit 103 may receive a more detailed text message, such as "Accident 5 miles ahead on the exit ramp for Highway 9." Circuit 103 may invoke translator 104 to translate the received text. Circuit 103 may the broadcast the translated speech as an audio announcement.

Interrogator 30 may be connected to a real-time traffic information system 32, such as that shown at www.traffic-.com, which may determine the status of various sections of the highway and may determine when to provide announcements to vehicles passing a particular interrogator 30 (which may cover a particular section of the highway). It will be appreciated that the description of system 32 as a real-time traffic information system may be exemplary. The present invention may also include an interface with any other system that may provide relevant information to a driver in that general location. For example, system 32 may also be a weather service that may provide information regarding driving conditions in the general area of the vehicle.

In accordance with a preferred embodiment of the present invention, transponder 101 is an electronic card located within a closed casing. Furthermore, the audio speaker may be within the transponder.

Transponder 101 may have two modes of operation: passive and active. When operating in passive mode, transponder 101 may respond to a command requesting identification from interrogator 30. Active mode may be triggered by receipt of a different command that may indicate a verbal announcement for the driver of the vehicle.

It will be appreciated that the present invention may not be limited to implementation within the context of a toll highway. Transponder 101 may be configured to receive commands from interrogators 30 installed on any electronically controlled/monitored road or highway, regardless of whether or not a toll may be charged for usage. Such roads and highways may be monitored, for example, in the interests of security and/or traffic safety. In such a context, it may also be beneficial to implement verbal announcements for the driver using transponders 101.

It will similarly be appreciated that the present invention may be implemented within the context of any transponder based system such as those discussed hereinabove. For example, interrogators 30 and transponders 101 may also be used in conjunction with weigh in motion (WIM) applications, access control and management, traffic management probes and other location based services.

Figure 3:
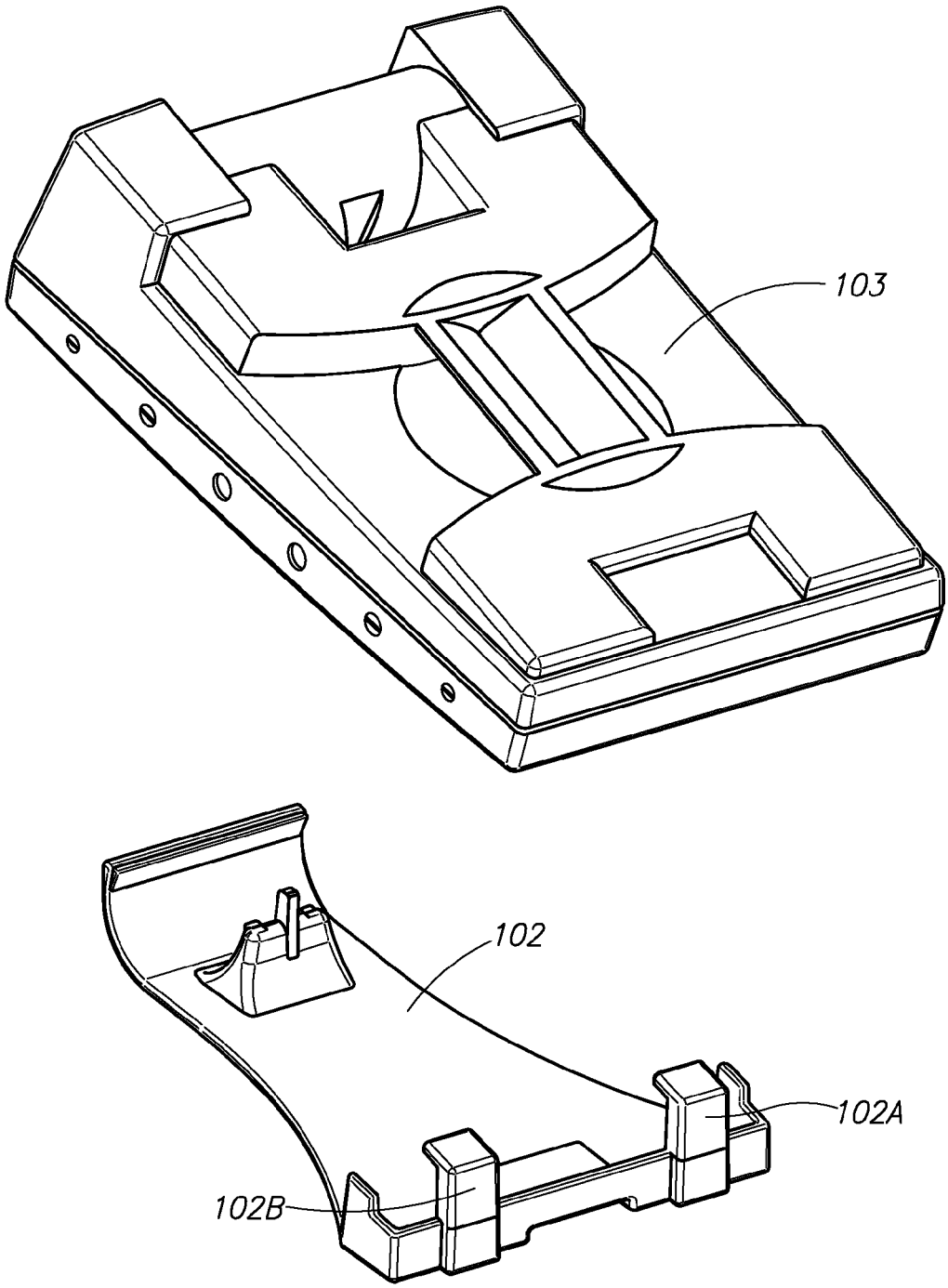
FIG. 3 is a schematic illustration of a transponder to be used in the system of FIG. 2.

FIG. 3, to which reference is now made, shows a transponder 1 with audio announcement circuit 103 and a hanging device 102 according to an embodiment of the present invention. As before, the transponder is attached to the internal surface of the windshield, or to a nearby location by means of the hanging device 102. The hanging device 102 has a double sided adhesive (not shown) at its rear surface, and hangers 102*a* and 102*b* at the front. The hanging device 102 is generally attached to the windshield at a location which may minimize obstruction of the driver's view, for example, behind the front mirror.

Unless specifically stated otherwise, as apparent from the preceding discussions, it is appreciated that, throughout the specification, discussions utilizing terms such as "processing," "computing," "calculating," "determining," or the like, refer to the action and/or processes of a computer, computing system, or similar electronic computing device that manipulates and/or transforms data represented as physical, such as electronic, quantities within the computing system's registers and/or memories into other data similarly represented as physical quantities within the computing system's memories, registers or other such information storage, transmission or display devices.

Embodiments of the present invention may include apparatus for performing the operations herein. This apparatus may be specially constructed for the desired purposes, or it may comprise a general-purpose computer selectively activated or reconfigured by a computer program stored in the computer. Such a computer program may be stored in a computer readable storage medium, such as, but not limited to, any type of disk, including floppy disks, optical disks, magnetic-optical disks, read-only memories (ROMs), compact disc read-only memories (CD-ROMs), random access memories (RAMs), electrically programmable read-only memories (EPROMs), electrically erasable and programmable read only memories (EEPROMs), magnetic or optical cards, Flash memory, or any other type of media suitable for storing electronic instructions and capable of being coupled to a computer system bus.

The processes and displays presented herein are not inherently related to any particular computer or other apparatus. Various general-purpose systems may be used with programs in accordance with the teachings herein, or it may prove convenient to construct a more specialized apparatus to perform the desired method. The desired structure for a variety of these systems will appear from the description below. In addition, embodiments of the present invention are not described with reference to any particular programming language. It will be appreciated that a variety of programming languages may be used to implement the teachings of the invention as described herein.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

What is claimed is:

1. An automatic vehicle identification (AVI) unit comprising:

a transponder to communicate with an interrogator regarding at least an identification of a vehicle in which said AVI unit is located, wherein said transponder has standby and active modes, wherein when in said standby mode said transponder sends an identification signal upon receipt of an identification request from said interrogator, and when in said active mode said transponder receives commands from said interrogator; and an audio speaker to broadcast verbal announcements based on information received from said interrogator.

2. The AVI unit according to claim 1 and also comprising:

a translator module to translate said information to said announcements as per a list of said commands and associated said verbal announcements.

3. The AVI according to claim 2 and wherein said translator module comprises at least one of: a command translator to translate system commands to pre-recorded audio announcements, and a text to speech translator to generate new audio announcements.

4. The AVI unit according to claim 1 and where said verbal announcements relay information regarding at least one of: road status, speed limitations, weather conditions and reminders.

5. The AVI unit according to claim 1 and where said verbal announcements are relevant to a current location of said vehicle.

6. The AVI unit according to claim 1 and wherein said interrogator is part of a highway monitoring system.

7. The unit according to claim 6 and wherein said highway is a toll highway.

8. The AVI unit according to claim 1 and wherein said interrogator is part of at least one of a weigh in motion (WIM) application, access control and management system, traffic management probe, and a location based service.

9. The unit according to claim 1 and wherein the transponder is an electronic card located within a closed casing.

10. The unit according to claim 1 and wherein said verbal announcements pertain to a current location of said vehicle.

11. A highway monitoring and broadcast system comprising:

means to collect and analyze activity on said highway and to determine when such activity requires sending information to vehicles on said highway; and an interrogator to communicate with AVI transponders installed in said vehicles, wherein said transponders have standby and active modes, wherein when in said standby mode said transponders send identification signals upon receipt of an identification request from said interrogator, and when in said active mode said transponders receive commands from said interrogator.

12. The system according to claim 11 and wherein said means comprise an interface with at least one of a real-time traffic information system and a weather reporting system.

13. The system according to claim 11 and wherein said highway is a toll highway and said interrogators comprise means to receive said identification signals from said AVI transponders, said identification signals being suitable for billing purposes.

14. The system according to claim 11 and wherein said interrogator comprises means to at least forward information to said vehicles, said information regarding at least one of road status, speed limitations, weather conditions and reminders.

15. The system according to claim 14 and wherein said information is relevant to a current location of said vehicles.

16. The system according to claim 11 and wherein said interrogator is part of at least one of a weigh in motion (WIM) application, access control and management system, traffic management probe, and a location based service.

* * * * *